US011181260B2

(12) United States Patent
Nurmi et al.

(10) Patent No.: US 11,181,260 B2
(45) Date of Patent: Nov. 23, 2021

(54) LED LAMP

(71) Applicant: Ellego Powertec Oy, Halikko As (FI)

(72) Inventors: Jari Nurmi, Turku (FI); Otto Vainio, Turku (FI)

(73) Assignee: Ellego Powertec Oy, Halikko As (FI)

( * ) Notice: Subject to any disclaimer, the term of this patent is extended or adjusted under 35 U.S.C. 154(b) by 0 days.

(21) Appl. No.: 16/919,142

(22) Filed: Jul. 2, 2020

(65) Prior Publication Data

US 2021/0025581 A1 Jan. 28, 2021

(30) Foreign Application Priority Data

Jul. 24, 2019 (EP) ..... 19188105

(51) Int. Cl.

| | |
|---|---|
| ***F21V 29/70*** | (2015.01) |
| ***F21V 29/508*** | (2015.01) |
| ***F21K 9/20*** | (2016.01) |
| ***F21V 7/10*** | (2006.01) |
| ***F21V 23/00*** | (2015.01) |
| ***F21V 23/06*** | (2006.01) |
| *F21Y 115/10* | (2016.01) |

(52) U.S. Cl.

CPC ..... *F21V 29/70* (2015.01); *F21K 9/20* (2016.08); *F21V 7/10* (2013.01); *F21V 23/006* (2013.01); *F21V 23/06* (2013.01); *F21V 29/508* (2015.01); *F21Y 2115/10* (2016.08)

(58) Field of Classification Search

CPC ..... F21V 29/70; F21V 29/508

See application file for complete search history.

(56) References Cited

U.S. PATENT DOCUMENTS

| | | | | |
|---|---|---|---|---|
| 2012/0206933 | A1* | 8/2012 | Isogai | F21V 23/006 362/555 |
| 2012/0224363 | A1* | 9/2012 | Deven | F21K 9/60 362/231 |
| 2012/0236573 | A1* | 9/2012 | Yamamoto | F21K 9/232 362/311.02 |
| 2012/0275145 | A1* | 11/2012 | Isogai | F21K 9/232 362/217.05 |
| 2012/0287632 | A1* | 11/2012 | Takahashi | F21K 9/60 362/235 |
| 2012/0307493 | A1* | 12/2012 | Betsuda | F21K 9/232 362/235 |
| 2013/0114251 | A1 | 5/2013 | Duan | |
| 2013/0128573 | A1* | 5/2013 | Leung | F21K 9/23 362/235 |
| 2013/0170199 | A1 | 7/2013 | Athayle et al. | |
| 2015/0241000 | A1 | 8/2015 | Barnetson et al. | |
| 2018/0206304 | A1 | 7/2018 | Su | |
| 2019/0063691 | A1 | 2/2019 | Dendorfer et al. | |

OTHER PUBLICATIONS

European Patent Office, Search Report of EP19188105, dated Jan. 16, 2020, 3 pages.

* cited by examiner

*Primary Examiner* — Bryon T Gyllstrom
*Assistant Examiner* — Christopher E Dunay
(74) *Attorney, Agent, or Firm* — Merchant & Gould P.C.

(57) ABSTRACT

The present invention relates to an LED lamp that comprises a first printed circuit board having a heat conducting core, an LED mounted on a first side of the first printed circuit board, a second printed circuit board, a rectifier mounted on the second printed circuit board, and a heat dissipating element connected between the second printed circuit board and a second side of the first printed circuit board for dissipating heat.

10 Claims, 3 Drawing Sheets

LED LAMP

PRIORITY

This application claims priority of European patent application number 19188105.1 which was filed on Jul. 24, 2019, the contents of which are incorporated herein by reference.

TECHNICAL FIELD OF THE INVENTION

The present invention relates to an LED (light-emitting diode) lamp according to the preamble of the appended independent claim. The invention also relates to a lighting fixture incorporating such an LED lamp.

BACKGROUND OF THE INVENTION

LED lamps or light bulbs are widely used in various lighting fixtures and systems because of their energy efficiency and long lifetime. A conventional LED lamp comprises an LED for emitting light, a heat sink for dissipating heat generated by the LED and a built-in driver circuit for driving the LED. The LED, the heat sink and the electrical components of the driver circuit are mounted on a printed circuit board.

Even though an LED is highly efficient, a high amount of electrical power in the LED is still converted to heat rather than light. This excess heat must be conducted away from the LED because the semiconductor material is limited to a maximum temperature and its characteristic properties, such as forward voltage, wavelength, light intensity and lifetime, change significantly as the temperature increases.

For the thermal management of an LED lamp, various techniques are known. Fundamentally, the aim of thermal management is to transfer the heat generated by the LED into the ambient air to prevent the LED overheating. The thermal management can be broken down into three system levels: the LED itself, the printed circuit board, and the heat sink. The heat path for the system heat transfer can be described in the same terms. The heat generated in the LED barrier layer is transmitted through the LED housing on to the printed circuit board and from there to the heat sink. From the heat sink, the heat is transferred to the ambient environment through natural convection and thermal radiation.

A problem associated with known LED lamps is that the heat transfer away from the LED is far from optimal and thus it prevents utilising the full performance, efficiency and lifetime of the LED lamp.

OBJECTIVES OF THE INVENTION

It is the main objective of the present invention to reduce or even eliminate the prior art problems presented above.

It is an objective of the present invention to provide an LED lamp with good thermal management. In more detail, it is an objective of the invention to provide an LED lamp in which the heat generated by an LED and other electrical components can be effectively dissipated away from the LED lamp.

It is also an objective of the present invention to provide a lighting fixture enabling to effectively dissipate heat away from an LED lamp.

In order to realise the above-mentioned objectives, the LED lamp according to the invention is characterised by what is presented in the characterising portion of the appended independent claim. Advantageous embodiments of the invention are described in the dependent claims.

DESCRIPTION OF THE INVENTION

An LED lamp according to the invention comprises a first printed circuit board having a heat conducting core, an LED mounted on a first side of the first printed circuit board, a second printed circuit board, a rectifier mounted on the second printed circuit board, and a heat dissipating element connected between the second printed circuit board and a second side of the first printed circuit board for dissipating heat.

The LED lamp according to the invention has separate printed circuit boards for the LED and the rectifier. The heat conducting core (layer) of the first printed circuit board functions as a heat spreader and thus improves thermal management. The heat conducting core of the first printed circuit board effectively draws heat from the LED. From the heat conducting core, the heat may conduct to the heat dissipating element. The second printed circuit board may also have a heat conducting core that functions as a heat spreader. The heat conducting core of the second printed circuit board effectively draws heat from the rectifier. The heat conducting core can be a metal core or a ceramic core. The metal core can, for example, be made of aluminium or copper. The ceramic core can, for example, be made of alumina or aluminium nitride. The size of each printed circuit board can be, for example, 100-1000 $mm^2$.

The LED is mounted on the first side of the first printed circuit board. The LED can be a surface mount LED that is placed directly onto the surface of the first printed circuit board. Preferably, the LED is thermally connected, for example by soldering, to the heat conducting core of the first printed circuit board. The LED can be a high-power LED that is driven at currents from 10 mA to 10 A and produces a luminous flux from 10 Im to 10000 Im. The LED lamp according to the invention may comprise one LED or a plurality of LEDs. The LED lamp may comprise a row or array of LEDs mounted on the first side of the first printed circuit board. The number of the LEDs on the row or the array can be, for example, 2-10 or 10-50.

The rectifier that is mounted on the second printed circuit board is used to convert AC (alternating current) power to DC (direct current) power. The output of the rectifier is electrically connected to the LED through an electrical connection between the first printed circuit board and the second printed circuit board. The electrical components of the rectifier can be mounted on one or both sides of the second printed circuit board. The electrical components of the rectifier can be placed directly onto the surface of the second printed circuit board. The electrical components of the rectifier can be thermally connected, for example by soldering, to the core of the second printed circuit board. The core of the second printed circuit board can be a heat conducting core. The rectifier is preferably a bridge rectifier comprising four diodes.

The heat dissipating element is connected to the second side of the first printed circuit board for dissipating heat from the first printed circuit board to which heat generated by the LED is conducted. Preferably, the heat dissipating element is thermally connected, for example by soldering, to the heat conducting core of the first printed circuit board and aligned with the LED that is mounted on the first side of the first printed circuit board. The heat dissipating element is also connected to the second printed circuit board for dissipating heat from the second printed circuit board. The heat dissipating element can be connected to one of the sides or edges of the second printed circuit board. The heat dissipating element can be thermally connected, for example by soldering, to the core of the second printed circuit board. The heat dissipating element increases significantly the heat dissipation capacity of the LED lamp. The heat dissipating element can be made of metal or ceramic. The size of the heat dissipating element can be, for example, 0.05-3.0 $cm^3$.

The LED lamp may comprise a body to which the first and second printed circuit boards and possibly some other components of the LED lamp are mechanically connected. The body can be made of, for example, ceramic, aluminium, brass or copper.

The LED lamp according to the invention has many technical features, each of which separately and all of which together improve the thermal management of the LED lamp. The first feature is the use of the heat conducting core in the first printed circuit board. This enables to effectively spread heat. The second feature is the use of separate printed circuit boards for the LED and the rectifier. This enables to better dissipate the heat generated by the LED and the rectifier and to lower the maximum temperature in the LED lamp because the heat generating components are apart from each other in separate printed circuit boards. The third feature is the use of the heat dissipating element connected to the second side of the first printed circuit board. This enables to effectively draw heat from the LED that is mounted on the first side of the first printed circuit board. The fourth feature is the use of the heat dissipating element connected to the second printed circuit board. This enables to effectively conduct heat away from the second printed circuit board.

The LED lamp according to the invention is intended to be used in a lighting fixture. The LED lamp can be designed in such a manner that when the LED lamp is installed in the lighting fixture the first printed circuit board is in contact with a body of the lighting fixture, whereby heat can conduct from the LED lamp to the lighting fixture. Preferably, the heat conducting core of the first printed circuit board is thermally connected to the body of the lighting fixture.

An advantage of the LED lamp according to the invention is that it has a good thermal management, allowing the heat generated by the LED and other electrical components to be effectively dissipated away from the LED lamp.

According to an embodiment of the invention the first printed circuit board comprises at least one heat conducting element on its first and/or second side for conducting heat away from the first printed circuit board. The heat conducting element is thermally connected to the heat conducting core of the first printed circuit board. The heat conducting element is arranged on the surface of the first printed circuit board in such a manner that when the LED lamp is installed in a lighting fixture the heat conducting element is in contact with a body of the lighting fixture. The first printed circuit board may comprise heat conducting elements on its both sides. The number of the heat conducting elements can be, for example, 1, 2, 3 or more than 3. The heat conducting element can be made of copper, aluminium, ceramic, or silicon or silver pastes or pads.

According to an embodiment of the invention the second printed circuit board is arranged perpendicularly with respect to the first printed circuit board and the heat dissipating element is connected to an edge of the second printed circuit board. The heat dissipating element can be thermally connected, for example by soldering, to the core of the second printed circuit board. An advantage of arranging the second printed circuit board perpendicularly with respect to the first printed circuit board is that the LED lamp fits well to certain types of lighting fixtures.

According to an embodiment of the invention the second printed circuit board is arranged in parallel with respect to the first printed circuit board and the heat dissipating element is connected to a first side of the second printed circuit board. The heat dissipating element can be thermally connected, for example by soldering, to the core of the second printed circuit board. The distance between the first and second printed circuit boards can be, for example, 1-20 mm. An advantage of arranging the second printed circuit board in parallel with respect to the first printed circuit board is that the LED lamp fits well to certain types of lighting fixtures.

According to an embodiment of the invention the LED is mounted essentially in the centre of the first printed circuit board. An advantage of mounting the LED essentially in the centre of the first printed circuit board is that the heat from the LED can spread equally in all directions on the first printed circuit board, which improves thermal management.

According to an embodiment of the invention the heat dissipating element is aligned with the LED. This means that the heat dissipating element is located at the same position as the LED, but on the other side of the first printed circuit board. An advantage of aligning the heat dissipating element with the LED is that the heat from the LED can be effectively dissipated from the LED to the heat dissipating element.

According to an embodiment of the invention the LED lamp comprises first electrical connectors for establishing an electrical connection between the first printed circuit board and the second printed circuit board. Preferably, the LED lamp comprises two first electrical connectors, which are arranged symmetrically with respect to the LED. The output of the rectifier is electrically connected through the first electrical connectors to the LED for supplying DC power to the LED.

According to an embodiment of the invention the first electrical connector comprises a male-female connector pair, the male connector being connected to the second printed circuit board and arranged to go through a hole in the first printed circuit board and to couple with the female connector that is connected to the first side of the first printed circuit board. The male and female connectors are arranged perpendicularly with respect to the first printed circuit board. The male connector can be connected to one of the sides or edges of the second printed circuit board. The male connector penetrates through the hole in the first printed circuit board and extends into the female connector, the opening of which is connected to the first side of the first printed circuit board. The female connector extends away from the first side of the first printed circuit board.

According to an embodiment of the invention the LED lamp comprises second electrical connectors connected to the second printed circuit board for supplying AC power to the rectifier. The second electrical connectors are electrically connected to the input of the rectifier. Preferably, the LED lamp comprises two second electrical connectors. The second electrical connectors can be, for example, pins designed to fit into the holes of a lamp socket, or wire leads suitable for direct connection to screw terminals or other wires. The LED lamp can be electrically connected to a lighting fixture with the second electrical connectors.

According to an embodiment of the invention the LED lamp comprises a prism holder connected to the first side of the first printed circuit board, and a prism connected to the prism holder for shaping the light distribution of the LED. The prism can be designed for each application to provide a desired light distribution. The prism can be designed, for example, in such a manner that the light distribution of the LED lamp resembles that of a halogen lamp. The prism holder can be ring-shaped and arranged around the LED. The prism is attached to the prism holder above the LED and at a distance from the first printed circuit board. The prism can be cylindrical in shape. The prism holder is made of an electrically non-conductive material, such as plastic. The prism is made of a translucent material, such as PMMA, PC or glass.

According to an embodiment of the invention the LED lamp comprises a reflector for reflecting light emitted from the LED. The reflector is preferably used together with the prism to provide the desired light distribution. The reflector can be attached to the prism holder. The shape of the reflector can be designed together with the prism. The reflector can be made of aluminium, plastic, glass, or a combination of these materials. The surface of the reflector can be polished, or it can be provided with a suitable coating. The reflector can be provided with a cover made of a translucent material, such as glass or plastic.

The present invention also relates to a lighting fixture. The lighting fixture according to the invention comprises a body having a lamp socket, and an LED lamp according to the invention connected to the lamp socket so that the first printed circuit board is in contact with the body for conducting heat from the LED lamp to the lighting fixture. The body of the lighting fixture can be provided with one or more heat conducting elements for dissipating heat away from the first printed circuit board. Alternatively, the body can be made of a heat conducting material, such as, aluminium. The lamp socket supports and provides an electrical connection for the LED lamp. The lamp socket allows the LED lamp to be safely and conveniently replaced.

An advantage of the lighting fixture according to the invention is that heat can be effectively dissipated away from the LED lamp.

The lighting fixture according to the invention can be used in a lighting system. A preferred lighting system is an AGL (Aeronautical Ground Lighting) system that comprises a power supply for supplying AC power to lighting fixtures located on and around runways and taxiways. These lighting fixtures are used to illuminate location, layout, shape and purpose of runways and taxiways so that airline pilots can operate in all conditions, especially in dark, low light and low visibility conditions. The amount of electrical power fed to the lighting fixtures of the AGL system may be regulated by adjusting the output current to the required level. This may be performed by a constant current regulator unit (CCR) so that the output current of the constant current regulator unit regulates also the intensity of lamps at runways and taxiways.

Traditionally, halogen lamps have been used in AGL systems. The halogen lamps have been tuned to provide 0-100% brightness with operating currents ranging from 2.8 to 6.6 A. Due to the relatively large current required even for the dimmest brightness level, there is a considerable offset in the current required for powering halogen AGL circuits, resulting in over 40% wasted energy. Furthermore, the high energy requirements of the halogen lamps necessitate the use of high voltage power supplies for powering AGL circuits with either a high number of lighting fixtures, or high brightness levels required from individual lighting fixtures. In contrast to halogen lamps, LED lamps start to produce light as soon as any current runs through the LED component and the intensity vs. current behaviour is linear to a high degree of accuracy. Brightness level control between 1% and 100% therefore requires average current control accuracy starting from almost zero current.

The exemplary embodiments of the invention presented in this text are not interpreted to pose limitations to the applicability of the appended claims. The verb "to comprise" is used in this text as an open limitation that does not exclude the existence of also unrecited features. The features recited in the dependent claims are mutually freely combinable unless otherwise explicitly stated.

The exemplary embodiments presented in this text and their advantages relate by applicable parts to the LED lamp as well as the lighting fixture according to the invention, even though this is not always separately mentioned.

DETAILED DESCRIPTION OF THE DRAWINGS

The same reference signs are used of the same or like components in different embodiments.

Figure 1:
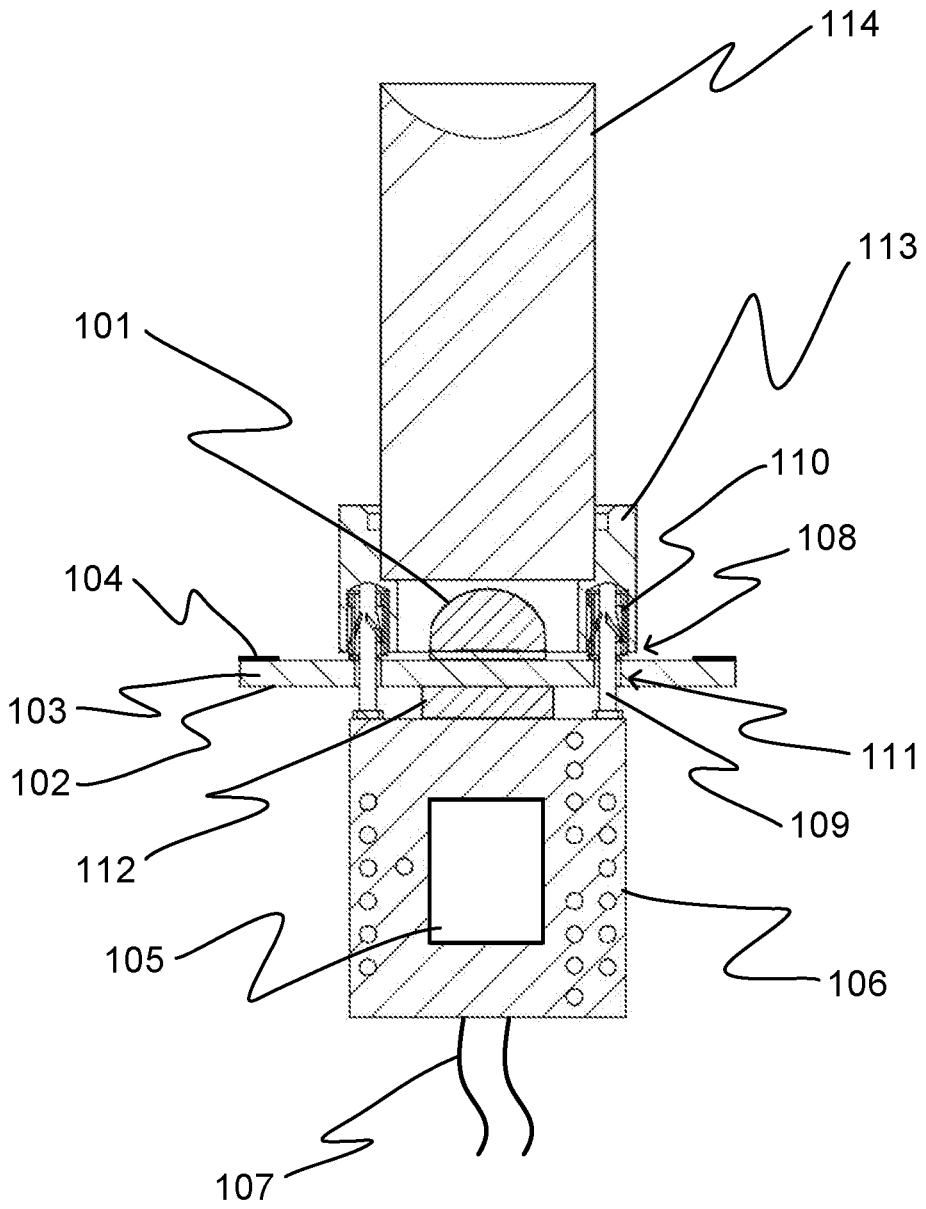
FIG. 1 illustrates a cross sectional view of an LED lamp according to a first embodiment of the invention.

FIG. 1 illustrates a cross sectional view of an LED lamp according to a first embodiment of the invention. The LED lamp comprises an LED 101 that is mounted on a first side of a first printed circuit board 102. The LED 101 is mounted essentially in the centre of the first printed circuit board 102. The first printed circuit board 102 has a heat conducting core 103 that functions as a heat spreader. The LED 101 is thermally connected by soldering to the heat conducting core 103.

The first printed circuit board 102 comprises heat conducting elements 104 on its first side for conducting heat away from the first printed circuit board 102. The heat conducting elements 104 are thermally connected to the heat conducting core 103 of the first printed circuit board 102. The heat conducting elements 104 are arranged on the surface of the first printed circuit board 102 in such a manner that when the LED lamp is installed in a lighting fixture the heat conducting elements 104 are in contact with a body of the lighting fixture.

The LED lamp comprises a rectifier 105 that is mounted on a second printed circuit board 106. The second printed circuit board 106 is arranged perpendicularly with respect to the first printed circuit board 102. The rectifier 105 converts AC power to DC power. The input of the rectifier 105 is electrically connected to electrical connectors 107 through which AC power is supplied to the LED lamp. The electrical connectors 107 are wire leads suitable for direct connection to terminals in a lighting fixture. The output of the rectifier 105 is electrically connected through electrical connectors 108 to the LED 101 so that the LED 101 can be supplied with DC power. Each of the electrical connectors 108 comprises a male-female connector pair 109, 110. The male connector 109 is connected to the second printed circuit board 106 and arranged to go through a hole 111 in the first printed circuit board 102 and to couple with the female connector 110 that is connected to the first side of the first printed circuit board 102. The male and female connectors 109, 110 are arranged perpendicularly with respect to the first printed circuit board 102. The male connector 109 penetrates through the hole 111 in the first printed circuit board 102 and extends into the female connector 110, the opening of which is connected to the first side of the first printed circuit board 102. The female connector 110 extends away from the first side of the first printed circuit board 102.

The LED lamp comprises a heat dissipating element 112 that is connected between the second printed circuit board 106 and a second side of the first printed circuit board 102 for dissipating heat. The heat dissipating element 112 is thermally connected by soldering to the heat conducting core 103 of the first printed circuit board 102 and aligned with the LED 101 that is mounted on the first side of the first printed circuit board 102.

The LED lamp comprises a prism holder 113 connected to the first side of the first printed circuit board 102, and a prism 114 connected to the prism holder 113 for shaping the light distribution of the LED 101. The prism holder 113 is ring-shaped and arranged around the LED 101. The prism 114 is cylindrical in shape and it is attached to the prism holder 113 above the LED 101 and at a distance from the first printed circuit board 102. The female connectors 110 are attached into the prism holder 113.

Figure 2:
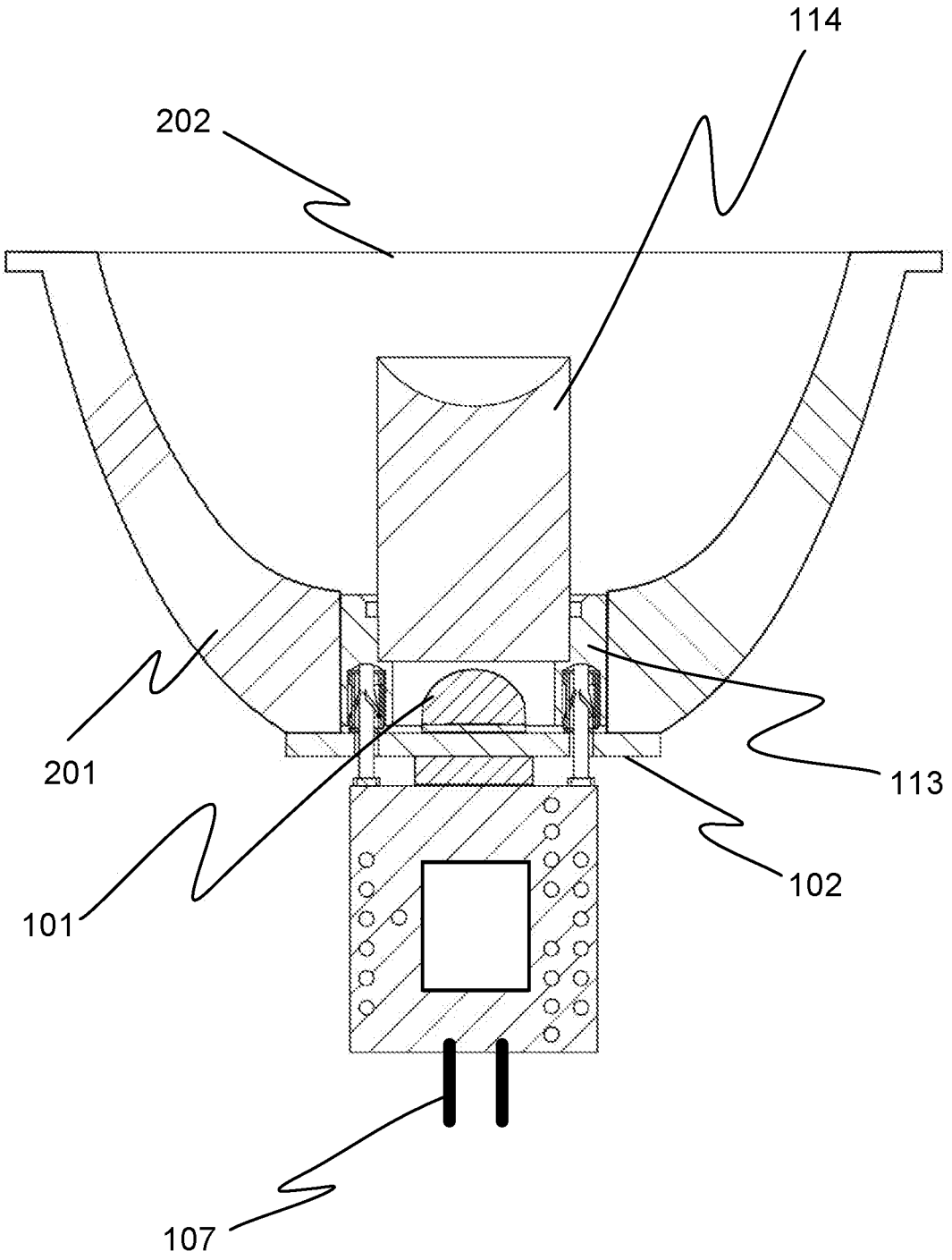
FIG. 2 illustrates a cross sectional view of an LED lamp according to a second embodiment of the invention.

FIG. 2 illustrates a cross sectional view of an LED lamp according to a second embodiment of the invention. The LED lamp of FIG. 2 resembles, with some differences, the LED lamp of FIG. 1. In the LED lamp of FIG. 2, the electrical connectors 107 that are used for supplying AC power to the LED lamp are pins. The pins can be inserted into the holes of a lamp socket in a lighting fixture. The LED lamp comprises a reflector 201 for reflecting light emitted from the LED 101. The reflector 201 is used together with the prism 114 to provide the desired light distribution. The reflector 201 is attached to the prism holder 113 so that is in contact with the first printed circuit board 102 and thus it enables to dissipate heat from the first printed circuit board 102. The reflector 201 is provided with a glass cover 202.

Figure 3:
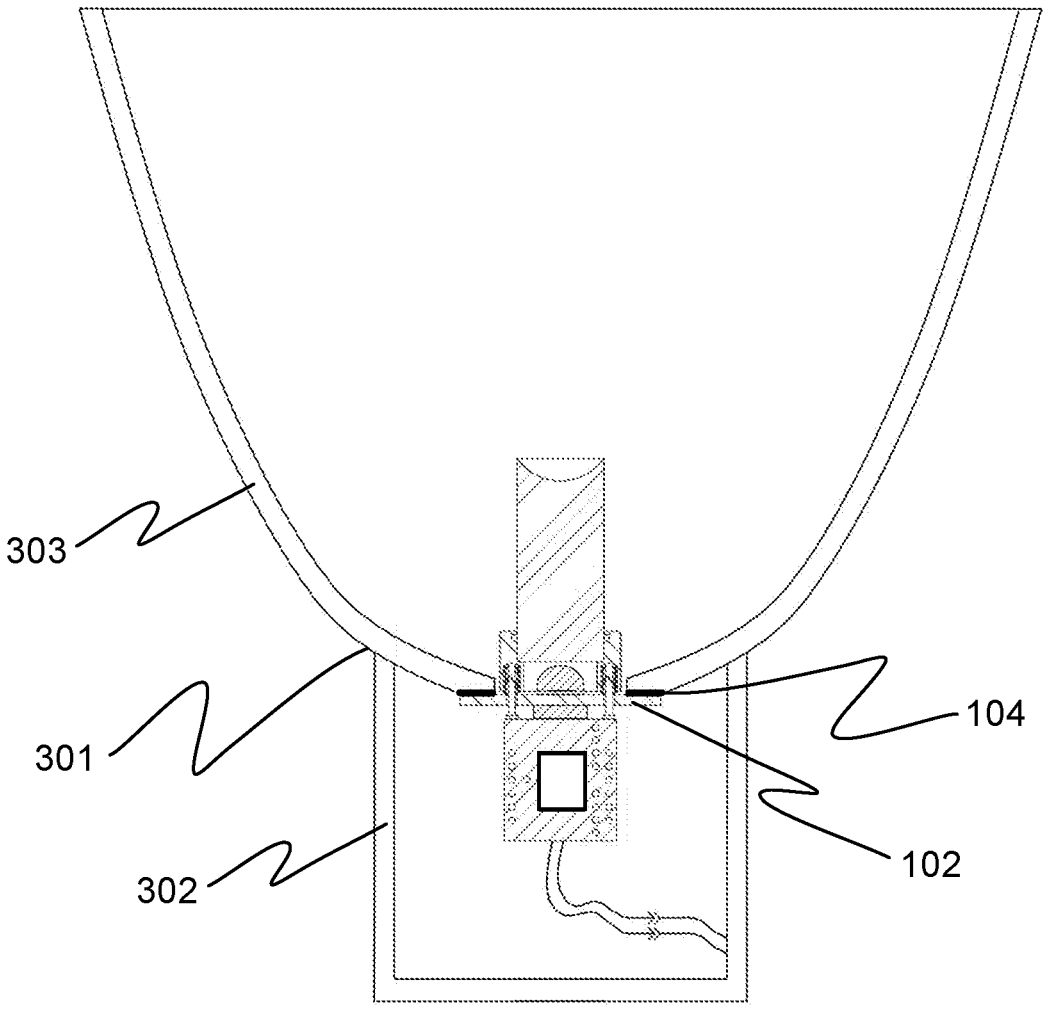
FIG. 3 illustrates a cross sectional view of a lighting fixture according to an embodiment of the invention.

FIG. 3 illustrates a cross sectional view of a lighting fixture according to an embodiment of the invention. The lighting fixture comprises a body 301 having a lamp socket 302 and a reflector 303. The lamp socket 302 supports and provides an electrical connection for the LED lamp of FIG. 1. The LED lamp is connected to the lamp socket 302 in such a manner that the heat conducting elements 104 of the first printed circuit board 102 are in contact with the body 301, which allows heat to conduct from the LED lamp to the lighting fixture.

Only advantageous exemplary embodiments of the invention are described in the figures. It is clear to a person skilled in the art that the invention is not restricted only to the examples presented above, but the invention may vary within the limits of the claims presented hereafter. Some possible embodiments of the invention are described in the dependent claims, and they are not to be considered to restrict the scope of protection of the invention as such.

The invention claimed is:

1. An LED lamp, wherein the LED lamp comprises:

a first printed circuit board having a heat conducting core, the heat conducting core comprising a metal core or a ceramic core;

an LED mounted on a first side of the first printed circuit board;

a second printed circuit board having a heat conducting core comprising a metal core or a ceramic core;

a rectifier mounted on the second printed circuit board; and a heat dissipating element connected between the second printed circuit board and a second side of the first printed circuit board for dissipating heat;

wherein the heat dissipating element is thermally connected with solder to the heat conducting core of the first printed circuit board, and the heat dissipating element is thermally connected with solder to the heat conducting core of the second printed circuit board, the second printed circuit board is arranged perpendicularly with respect to the first printed circuit board and the heat dissipating element is connected to an edge of the second printed circuit board.

2. The LED lamp according to claim 1, wherein the first printed circuit board comprises at least one heat conducting element on its first and/or second side for conducting heat away from the first printed circuit board.

3. The LED lamp according to claim 1, wherein the LED is mounted essentially in a centre of the first printed circuit board.

4. The LED lamp according to claim 1, wherein the heat dissipating element is aligned with the LED.

5. The LED lamp according to claim 1, wherein the LED lamp comprises first electrical connectors for establishing an electrical connection between the first printed circuit board and the second printed circuit board.

6. The LED lamp according to claim 5, wherein the first electrical connector comprises a male-female connector pair, the male connector being connected to the second printed circuit board and arranged to go through a hole in the first printed circuit board and to couple with the female connector that is connected to the first side of the first printed circuit board.

7. The LED lamp according to claim 1, wherein the LED lamp comprises second electrical connectors connected to the second printed circuit board for supplying AC power to the rectifier.

8. The LED lamp according to claim 1, wherein the LED lamp comprises a prism holder connected to the first side of the first printed circuit board, and a prism connected to the prism holder for shaping the light distribution of the LED.

9. The LED lamp according to claim 1, wherein the LED lamp comprises a reflector for reflecting light emitted from the LED.

10. A lighting fixture, comprising:

a body having a lamp socket, wherein the lighting fixture comprises an LED lamp according to claim 1 connected to the lamp socket so that the first printed circuit board is in contact with the body for conducting heat from the LED lamp to the lighting fixture.

* * * * *